United States Patent [19]

Nieppola

[11] Patent Number: 4,759,539

[45] Date of Patent: Jul. 26, 1988

[54] FOLD-DOWN EXCERCISE APPARATUS

[76] Inventor: Heikki Nieppola, Rusinniemenkatu 17, SF-35800 Mänttä, Finland

[21] Appl. No.: 34,180

[22] PCT Filed: Jul. 2, 1986

[86] PCT No.: PCT/FI86/00070

§ 371 Date: Feb. 24, 1987

§ 102(e) Date: Feb. 24, 1987

[87] PCT Pub. No.: WO87/00065

PCT Pub. Date: Jan. 15, 1987

[30] Foreign Application Priority Data

Jul. 8, 1985 [FI] Finland ..... 852684

[51] Int. Cl.[4] ..... A63B 17/00

[52] U.S. Cl. ..... 272/63; 272/112; 272/144; 182/95; 182/163

[58] Field of Search ..... 272/62, 109, 111, 112, 272/113, 144, 85, 57.5 R, 63; 108/11, 17; 182/82, 93, 95, 27, 163; 5/10 R, 133, 136

[56] References Cited

U.S. PATENT DOCUMENTS

| | | | |
|---|---|---|---|
| 316,643 | 4/1885 | Niehaus | 182/27 X |
| 1,080,867 | 12/1913 | Tracy | 5/136 X |
| 2,257,425 | 9/1941 | Mezzetti | 108/11 |
| 2,783,045 | 2/1957 | Bosch | 272/144 X |
| 3,032,344 | 5/1962 | Hjelte | 272/112 |
| 3,614,097 | 10/1971 | Buckman | 272/62 X |
| 4,564,194 | 1/1986 | Dawson | 272/144 X |
| 4,648,481 | 3/1987 | Lee | 272/134 X |

FOREIGN PATENT DOCUMENTS

| | | | |
|---|---|---|---|
| 65371 | of 1947 | Denmark | 272/112 |

*Primary Examiner*—Richard J. Apley
*Assistant Examiner*—David J. Bender

[57] ABSTRACT

An exercise apparatus comprises a plane formed by two elongated parts include a pivotal joint arrangement for accomplishing an angle between the parts of the lane. The plane of two parts comprises at the lower part thereof a stationary joint arrangement, which is arranged to be fixed substantially above the horizontal base. Locking devices are provided for locking the plane of two parts into erected vertical position. Adjustable supports are provided for supporting the plane of two parts to form an inclined plane between the stationary joint arrangement of the plane of two parts and the base and for supporting the plane to form an angular plane. The angular plane includes the first elongated part between the stationary joint arrangement and the joint arrangement of the plane of two parts in substantially horizontal position and the second elongated part between the joint arrangement of the plane and the base in substantially vertical position.

11 Claims, 3 Drawing Sheets

FOLD-DOWN EXCERCISE APPARATUS

BACKGROUND OF THE INVENTION

The present invention relates to an exercise apparatus.

The conventional exercise apparatuses of the kind to which the present invention relates has several drawbacks. Most of the apparatuses are not suitable for more than one type of body exercise. If the conventional apparatus is constructed for several body exercises the construction of the apparatus is very complicated and it requires significant space. U.S. Pat. No. 4,358,109 describes an adjustable exercise bench, which represents the state of art in the field of the exercise apparatuses. The construction described in this patent is very complicated, although the possibilities to vary the positions of the bench are limited, as far as the training of large groups of muscles is concerned. The use of the bench is complicated due to the great number of different adjustments necessary to change the positions of the body supporting members.

SUMMARY OF THE INVENTION

The purpose of this invention is to provide a novel exercise apparatus, which is easy to adjust for the training purposes of different groups of muscles. The apparatus has been constructed so, that requirement of space is not significant when the apparatus is arranged to its erected position.

To achieve the purpose of the invention the exercise apparatus includes first and second elongated members each with first and second ends. The first end of the first member is pivotally attached to a stationary vertical surface at the point on the surface substantially above the base of the vertical surface. The second end of the first member is pivotally connected to the first end of the second member. An adjustable support is connected to the second end of the second member. Means are provided to detachably attach the second member to the vertical surface above the first member such that the first and second members form a plane against the vertical surface when the second member is attached to the vertical surface. The construction of the exercise apparatus can be positioned so that all the great groups of muscular tissue, e.g. the muscles in the abdomen region, spinal region, arm region and leg region can be trained either in combination or separately.

The other embodiments include features which allow the combination of constructional parts of the exercise apparatus, so that most of them have a functional purpose in accomplishing a certain position of the exercise apparatus even if these parts are not used in the body exercise itself. The present invention provides a very simplified construction resulting from a deep analyzis of the needs of the body exercises and the function of the parts of the exercise apparatus, so that the assembly is integrated. The exercise apparatus in accordance with the present invention can also be used in private households because the need for space of the exercise apparatus is minimized. Thus, one purpose of the present invention is to provide private households with an exercise apparatus which is constructionally adapted to suit their demands. This kind of need is nowadays becoming more actual with increasing popularity of various body exercise courses.

The description hereinafter refers to one advantageous embodiment of the present invention with simultaneous references to the annexed drawings, in which

Figure 1:
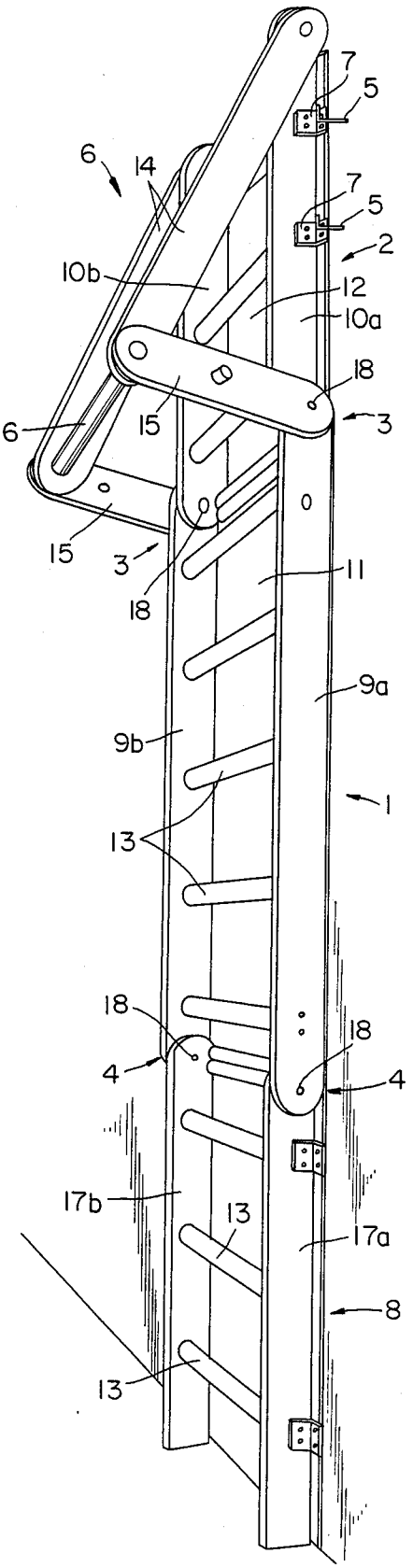
FIG. 1 shows a perspective view of the exercise apparatus in the first erected position.
Figure 2:
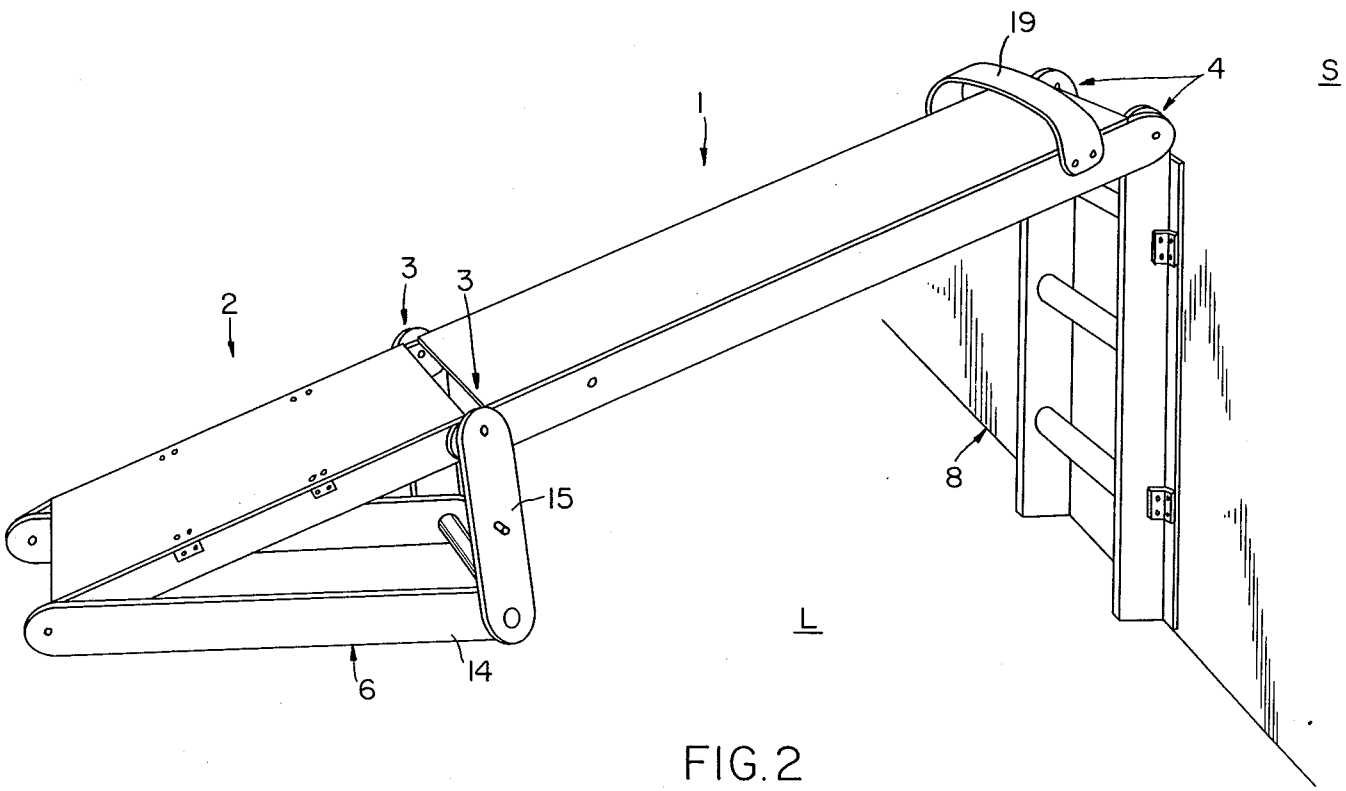
FIG. 2 shows also a perspective view of the exercise apparatus in the second position, in which the apparatus has the general form of an inclined plane
Figure 3:
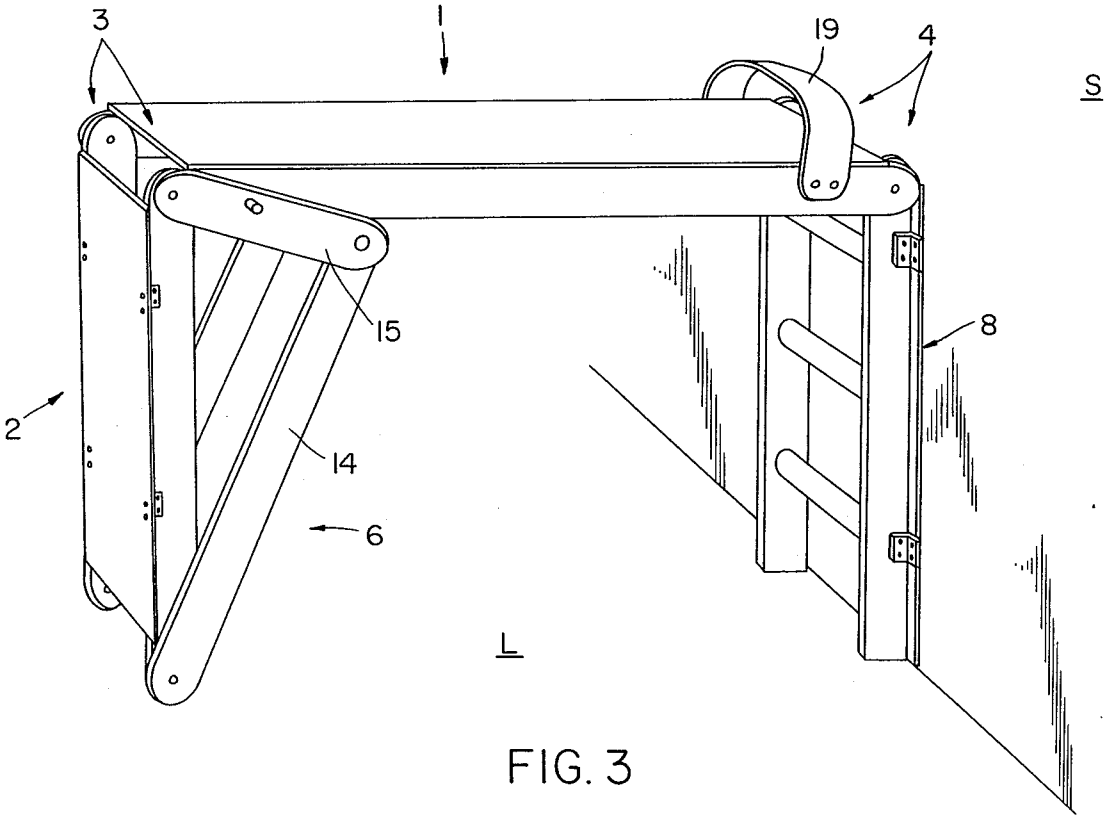
FIG. 3 shows also a perspective view of the exercise apparatus in the third position, where it has the general form of an angular plane.

As the Figures illustrate, the exercise apparatus can be adapted for different body exercises, because it can be quickly and easily assembled to different positions. In the erected vertical position the exercise apparatus forms a ladder comprising a set of horizontal rounds for exercise and in this position the exercise apparatus further comprises a single horizontal bar. From the erected position as shown in FIG. 1 the plane made of two parts 1, 2 can be put down onto the firm horizontal base L as shown in FIG. 2 whereby an inclined plane is formed between the firm horizontal base L and the stationary joint arrangement 4. Further the exercise apparatus can be positioned to form an angular plane as shown in FIG. 3, wherein the parts 1, 2 of the plane have been positioned in relation to each other by inflecting the plane at the joint arrangement 3 between these parts so that the parts 1, 2 form a substantially right angle. Hereby the first plane part 1 between the stationary joint arrangement 4 and the joint arrangement 3 connecting the planes 1, 2 is substantially in a horizontal position and the second plane part 2 between the joint arrangement 3 connecting the planes 1, 2 and the horizontal base L is substantially in a vertical position.

Although the exercise apparatus can be constructed within the scope of the present invention also in other ways it is advantageous to fix the exercise apparatus to a vertical base such as wall S especially in order to satisfy the requirements of domestic use and other small spaces. Hereby the stationary joint arrangement 4 at the bottom of the plane of two parts 1, 2 has been fixed to the wall S. Further means for locking the plane of two parts to the wall S in order to accomplish the erected, vertical position of the exercise apparatus can be fixed to the wall S. In FIG. 1 these fixing members are indicated by the reference numeral 5. The construction of these members can vary considerably and the such fixing members are commercially available so that their constructions are not described more closely. Further the plane of two parts 1, 2 comprises counterpart members 7, which have been attached to or formed on the plane of two parts 1, 2 in order to lock the exercise apparatus to its erected, vertical position by means of members 5.

The stationary joint arrangement 4 can be fixed to the vertical base S by means of a supporting part 8, which is placed beneath the plane of two parts 1, 2 and which suitably reaches the horizontal base L.

The parts 1, 2 of the plane of two parts comprise two parallel beams *9a, 9b; 10a, 10b*, in the longitudinal direction of the exercise apparatus. These beams have been attached to each other by means of plate parts 11, 12 so that they are substantially separated in the transversal direction of the exercise apparatus. These plate parts are placed in relation to the beams so that they face the vertical base S in the erected position of the exercise apparatus and in the positions where the plane of two parts 1, 2 has been put down, these plate parts are on the beams 9*a*, 9*b*; 10*a*, 10*b* providing an even plane on which the body exercises can be performed. The beams 9*a*, 9*b* and 10*a*, 10*b* have been connected in the both plane parts to each other by means of one or several horizontal rounds 13. The rounds 13 have been placed in relation to the beam constructions so that a suitable distance between them and the plate parts 11, 12 are accomplished for the functional purposes of the rounds. The supporting part advantageously includes beams 17*a*, 17*b* between which one or several rounds 13 have been attached in a similar manner as the rounds in the plane of two parts 1, 2. Thus the exercise apparatus comprises a set of ladder rounds along its total height in the erected, vertical position.

Supporting means 6 for supporting the plane of two parts 1, 2 alternatively to form the inclined plane of FIG. 2 or alternatively the angular plane of FIG. 3 includes a projecting angular beam arrangement 14, 15 fixed to the second plane part 2. The projecting angular beam arrangement comprises a first beam part 14, which projects in an inclined position from the upper edge of the second plane part 2. The angle between the first beam part 14 and the second plane part 2 corresponds substantially to the angle between the inclined plane and the horizontal base L in FIG. 2. The second beam part 15 is connected at one end to the freely projecting end of the first beam part 14 and at the other end is fixed to the joint arrangement 3 between the plane formed of two parts 1, 2. The angle between the longitudinal direction of the second beam part 15 and the plane part 2 is substantially a right angle. The projecting first beam part 14 lies against the horizontal base L when the exercise apparatus is positioned to form the inclined plane whereby the joint arrangement 3 is locked by means of the angular beam arrangement 14, 15, especially by means of the second beam part 15 which connects the joint arrangement 3 to the horizontal base L. For forming the angular plane shown in FIG. 3 from the plane of two parts, the second beam part and/or a bar 16 in connection with the second beam part, especially the horizontal bar is, brought to lie against the first plane part 1.

The horizontal bar 16 for exercise purposes is advantageously fixed to the exercise apparatus in such a manner, that the angular beam arrangement 14, 15 comprises two separate parts, which are fixed to each other at the horizontal bar and which are further fixed to the second plane part 2, especially to the beams thereof. The joint arrangements 3, 4 of the exercise apparatus have been formed so, that the horizontal distance between two surfaces facing to each other in the first plane part 1 e.g. the inner surfaces of the longitudinal beams 9*a*, 9*b* comprise substantially the horizontal distance between two surfaces facing away each other in the second plane part 2 and the supporting part 8 e.g. the outer surfaces of the beams 10*a*, 10*b*; 17*a*, 17*b*. Hereby the beams in all parts have been placed at the ends of the first plane part in an adjacent position in relation to each other. This enables the positioning of articulated rods 18 in the bores in the beams at the adjoining area. The joints can be provided also with other means which promote the positioning of the exercise apparatus in the different positions. Such means can include barrels, plates between the surfaces of the beams facing each other as well as other constructional parts of plastic or other suitable material which facilitate the above mentioned positioning.

The constructional materials which can be used for the exercise apparatus are wooden materials for the vertical beams, rounds and the angular beam arrangement are concerned. Accordingly, the plane parts can be made of wood based plate materials such as plywood, coated wooden particle board etc. The plane parts can further comprise a coating made of suitable material such as leather or plastic textile with suitable amount of pad between the wooden base plate and the coating material for the purposes of comfortability. The first plane part 1 can be provided with a belt arrangement 19 affixed to the first plane part and serving as a footrest for a person during the exercises on the plane of two parts.

As previously discussed, the exercise apparatus in accordance with the present invention is very suitable for domestic use, because the requirement concerning available space is very small when the exercise apparatus is in its erected vertical position, which simultaneously is in its storage position. On other hand the multiple purposes to which the exercise apparatus can be applied, means that it can be used also in schools and enterprises etc. It should be also noted that the support part 8 of the exercise apparatus can be placed on a movable base whereby the exercise apparatus can be moved supported by such base. On the other hand, especially in the domestic use, the supporting part 8 which reaches the horizontal base L is not necessary because there exists in the knowledge of a person skilled to the art, several ways to fix the stationary joint arrangement 4 to the wall so that the vertical distance between the horizontal base and the stationary joint arrangement corresponds substantially the length of the second plane part 2.

I claim:

1. An exercising apparatus comprising first and second elongated members each with first and second ends, the first end of the first member is pivotally attached to a stationary vertical surface at a point on the surface substantially above the base of the vertical surface, the second end of the first member is pivotally connected to the first end of the second member; an adjustable support means is connected to the second end of the second member; and means to detachably attach the second member to the vertical surface above the first member such that the first and second members form a plane against the vertical surface when the second member is attached to the vertical surface.

2. An exercise apparatus according to claim 1 wherein said adjustable support is adapted to support said plane formed by said first and second members in inclined and angular positions respectively with regard to a horizontal base.

3. An exercise apparatus according to claim 2 further including a stationary support member to which said first end of said first member is pivotally connected.

4. An exercise apparatus according to claim 3 wherein said stationary supporting member comprises a pair of longitudinal beams and a plurality of rounds extending therebetween.

5. An exercise apparatus according to claim 3 wherein each of said first and second elongated members comprise parallel, longitudinal beams spaced apart, and a plate member connected therebetween, each pair of said beams being separated from each other in the transversal direction of said apparatus.

6. An exercise apparatus according to claim 5 wherein said plate member connected to each pair of said beams is placed on the side of the beams facing said vertical surface and wherein said plate members substantially form said plane of said apparatus in said vertical position.

7. An exercise apparatus according to claim 5 further comprising a plurality of horizontal rounds spaced along said first and second members having opposite ends connected each to one of said beams.

8. An exercise apparatus according to claim 7 wherein said adjustable support comprises an angular beam arrangement connected to said second elongated member and including a first beam part projecting outwardly in an inclined position from said second member and a second beam part being arranged at a substantially right angle with respect to said second member, whereby said inclined first beam part is positioned against said horizontal base when said plane formed by said first and second members is arranged to be in said inclined position with respect to said horizontal base and whereby the second beam part and a horizontal bar attached thereto are placed against the second elongated member when said plane formed by said first and second members is positioned to form said angular plane.

9. An exercise apparatus according to claim 7 wherein said adjustable support means includes an angular beam arrangement formed of two beam members, each member of said angular beam arrangement being connected to said longitudinal beams of said second elongated member and a horizontal bar member being connected between said two beam members of the angular beam arrangement.

10. An exercise apparatus according to claim 8 wherein said stationary supporting member comprises a pair of longitudinal beams and a plurality of rounds extending therebetween.

11. An exercise apparatus according to claim 10 wherein joint members for pivotal mounting of said first and second members are formed at the horizontal distance between the inner surfaces of the longitudinal beams of the first elongated member corresponding substantially to the horizontal distance between the outer surface of the longitudinal beams of the second member and of said stationary support member, said longitudinal beams having adjacent ends aligned with respect to each other and rods being provided through bores formed in said adjacent ends to form said joint members.

* * * * *